United States Patent [19]

Zinni

[11] 4,430,869

[45] Feb. 14, 1984

[54] PENDANT FRAME WITH RETAINED ELEMENTS

[75] Inventor: Domenic A. Zinni, Cranston, R.I.

[73] Assignee: B.B. Greenberg Company, Providence, R.I.

[21] Appl. No.: 352,889

[22] Filed: Mar. 1, 1982

[51] Int. Cl.[3] ..... A44C 25/00

[52] U.S. Cl. ..... 63/23; 40/618; 63/29 R

[58] Field of Search ..... 63/1 R, 2, 29 R, 20, 63/23, 31; 40/618

[56] References Cited

U.S. PATENT DOCUMENTS

| | | | |
|---|---|---|---|
| 1,224,965 | 5/1917 | Schwartzman | 63/29 R |
| 1,486,753 | 3/1924 | Hynds | 63/2 UX |
| 1,783,223 | 12/1930 | Dauer | 63/20 X |
| 2,123,704 | 7/1938 | Meissner | 40/618 |
| 2,541,460 | 2/1951 | Bugh | 40/618 X |
| 3,605,438 | 9/1971 | Chalson | 63/29 R X |
| 3,893,819 | 7/1975 | Schaiewitz | 63/20 X |

FOREIGN PATENT DOCUMENTS

| | | | |
|---|---|---|---|
| 587526 | 1/1925 | France | 63/26 |
| 5842 | of 1893 | United Kingdom | 63/20 |

*Primary Examiner*—F. Barry Shay
*Attorney, Agent, or Firm*—Salter & Michaelson

[57] ABSTRACT

A jewelry ornament construction comprising an elongated pin and a plurality of ornament elements which have aligned apertures therethrough, and are slidingly received on the pin and retained thereon in generally aligned planar relation to form a composite ornament. Since the ornament elements are removably retained on the pin, the ornament is adapted for personalization with various desired combinations of elements, which may embody monogramatic and emblematic insignia.

1 Claim, 9 Drawing Figures

PENDANT FRAME WITH RETAINED ELEMENTS

BACKGROUND AND SUMMARY OF THE INVENTION

The instant invention relates to ornamental jewelry and the like, more particularly to a novel jewelry ornament construction.

Personalization of a variety of types of items including jewelry items has proven to be a highly desirable and effective marketing characteristic. In this regard, jewelry items bearing emblematic and/or monogramatic insignia or the like have proven highly popular, particularly in jewelry forms such as pendants, key chains, stick pins and the like. Unfortunately, it has frequently been impossible for many small jewelers to provide personalized jewelry items for their customers because of the impracticalities of maintaining large inventories of personalized jewelry bearing vast numbers of emblematic and/or monogramatic combinations. It has also proven impractical for many small jewelers to engage full time engravers to provide customization of jewelry items.

The instant invention provides a jewelry ornament construction which overcomes these and other disadvantages and which may be embodied in a variety of jewelry forms. In particular, the jewelry ornament of the instant invention is readily adaptable for personalization by individual jewelers, and therefore eliminates the necessity of maintaining substantial quantities of personalized jewelry items bearing differential emblematic and monogramatic combinations in inventory.

The ornament construction of the instant invention comprises a plurality of individual ornament elements which are disposed in generally aligned relation and have aligned apertures therethrough, an elongated pin which extends through the apertures to maintain the elements in aligned relation, means for detachably retaining the elements on the pin, and means attached to the pin for suspending the composite ornament from a jewelry necklace, chain or other jewelry member. The individual jewelry elements which preferably embody various emblematic or monogramatic insignia are detachably retained on the pin so that convenient customization of the ornament to suit the personal desires of each individual is possible. As a result, a jeweler who maintains a comparatively small inventory of a variety of the ornament elements can easily provide a vast variety of emblematic and monogramatic combinations to suit the needs and desires of each customer.

For the above reasons, it is the primary object of the instant invention to provide a jewelry ornament construction which is adaptable for personalization.

Another object of the instant invention is to provide a jewelry ornament construction which is readily adaptable for personalization and which can be embodied in a variety of jewelry forms.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
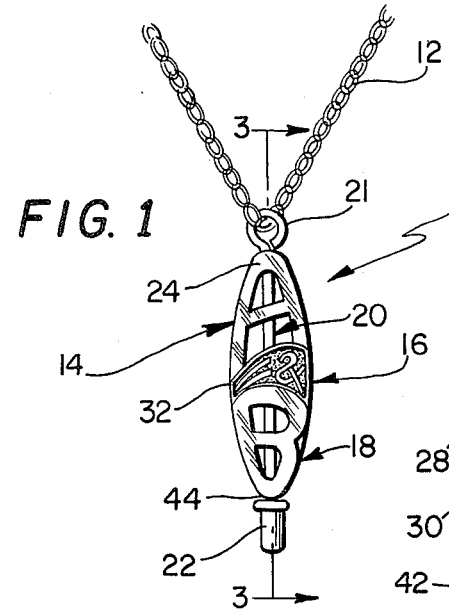
FIG. 1 is a front elevational view of a first embodiment of the ornament of the instant invention suspended from a jewelry chain.

Referring now to the drawings, particularly FIGS. 1 through 5, a first embodiment of the jewelry ornament of the instant invention which defines a jewelry pendant is generally indicated at 10. The pendant 10 which is of generally elongated oval configuration is adapted to be suspended from a jewelry chain 12 and generally comprises upper, intermediate, and lower pendant elements 14, 16 and 18, respectively, an elongated pin 20, an eyelet 21 which is integrally formed at one extremity of the pin 20, and a clutch 22 which is received on the opposite extremity thereof.

Figure 2:
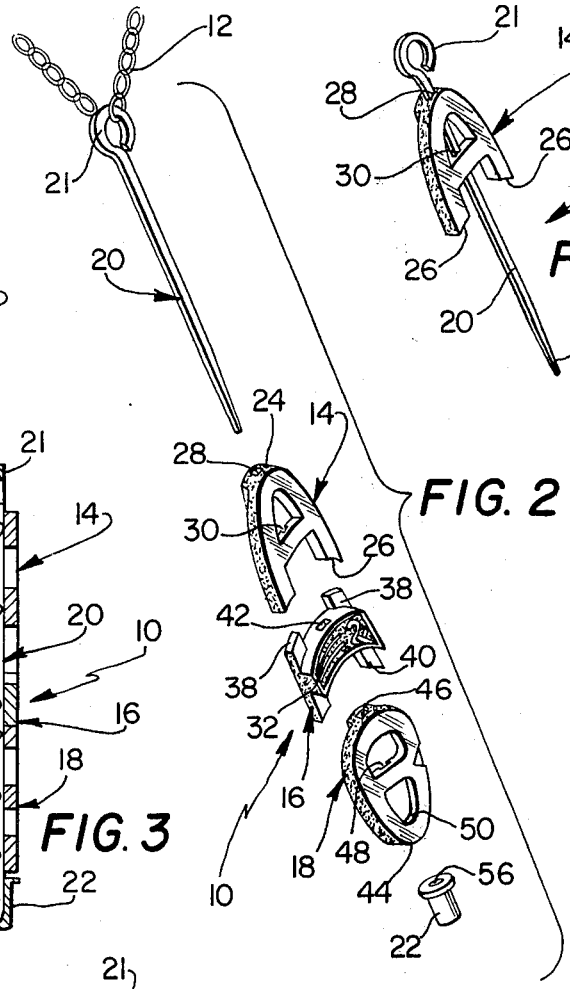
FIG. 2 is an enlarged exploded perspective view thereof.

Referring first to FIGS. 1 and 2, it will be seen that the elements 14 and 18 are embodied for purposes of illustration as the capital letters A and B, respectively, and that the element 16 is embodied as a zodiac sign. As will be further seen, the element 14 is characteristically defined by its A-shaped configuration but is formed in a generally arch-shaped configuration to adapt it to the general elongated oval shape of the pendant 10. The upper and lower extremities of the element 14, respectively are defined by an arcuate upper apex 24 and upwardly and inwardly inclined arcuate surfaces 26 which form the lower ends of the legs of the letter A. Aligned apertures 28 and 30 of substantially square cross section extend longitudinally through the element 14 extending through both the apex 24 and the cross bar section, respectively, of the letter A.

The intermediate element 16 includes a body section 32 having upper and lower arcuate surfaces 34 and 36, respectively, and pairs of spaced rearwardly offset upper and lower alignment arms 38 and 40, respectively, which extend generally longitudinally in the pendant 10. An aperture 42 of substantially square cross section extends through the front central portion of the body section 32 in a substantially longitudinal disposition relative to the overall pendant 10.

The lower element 18, as shown, is in substantially the configuration of a capital letter B which is slightly tapered at the lower end thereof and has arcuate upper and lower extremities 43 and 44, respectively. Aligned apertures 46, 48 and 50 of substantially square cross section extend through the upper, intermediate, and lower portions, respectively, of the letter B embodied on the element 18.

The pin 20 which is preferably integrally formed with the eyelet 21 comprises an elongated member of generally square cross section having a tapered extremity 52. The clutch 22 comprises a conventional jewelry clutch having a bore 56 preferably lined with a resilient material such as polyethylene, whereby the extremity 52 is receivable in frictional engagement.

Figure 5:
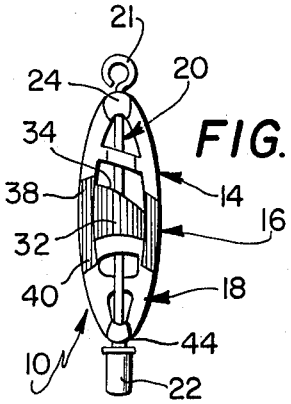
FIG. 5 is a rear view thereof.

As will be seen most clearly from FIGS. 1 and 5, the elements 14, 16 and 18 are disposed in substantially aligned abutting relation so that they cooperate to define the elongated oval configuration of the pendant 10, and the pin 20 is slindingly received in the aligned apertures 28, 30, 42, 46, 48 and 50. The clutch 22 is received on the pin 20 with the tapered extremity 52 received in frictional engagement in the clutch bore 56 whereby the clutch 22 and the eyelet 21 cooperate to longitudinally retain the elements 14, 16 and 18 in abutting relation on the pin 20. When the elements 14, and 18 are in assembled relation on the pin 20, the lower extremities 26 of the element 14 abut the arcuate upper surface 34 of the intermediate element 16 and the upper extremity 43 of the lower element 18 abuts the lower arcuate surface 36 of the intermediate element 16. Since the pin 20 and the apertures 28, 30, 42, 46, 48 and 50 are of substantially square cross section, the elements 14, 16 and 18 are nonrotatable relative to the pin 20 so that the emblematic and monogramtic figures embodied in the pendant 10 are maintained in generally planar relation. Further in this regard, when the elements 14, 16 and 18 are in assembled relation, the upper and lower alignment arms 38 and 40, respectively, engage in the lower and upper rear surfaces of the elements 14 and 18, respectively, adjacent the lower and upper extremities 26 and 43 thereof, respectively, to interfit the elements 14, 16 and 18 in aligned planar relation. As will be seen, when the elements 14, 16 and 18 are in assembled relation, they cooperate to define an attractive elongated oval-shaped pendant which has the appearance of being of unitary construction but which is actually adaptable to accomodate various mongramtic and emblematic elements to provide endless combinations of initials and zodiac signs.

Figure 6:
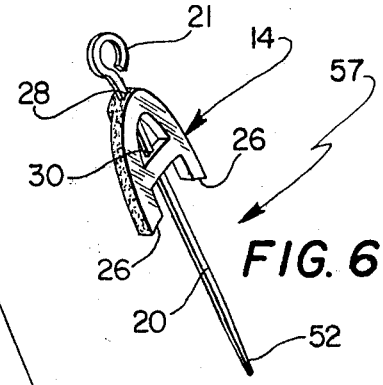
FIG. 6 is a perspective view of an alternate embodiment of the ornament.
Figure 3:
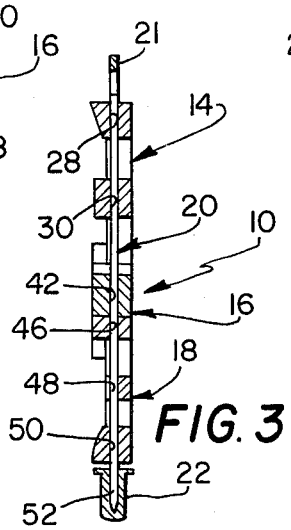
FIG. 3 is an enlarged sectional view taken along line 3—3 in FIG. 1.
Figure 4:
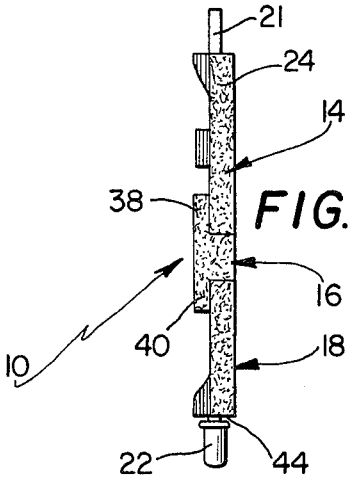
FIG. 4 is an enlarged side elevational view of the ornament.

An alternate embodiment of the ornament of the instant invention which defines a jewelry stick pin is generally indicated at 57 in FIG. 6. The stick pin 57, which comprises the pin 20 with the element 14 received thereon, is also adapted for personalization by substitution of elements embodying other initials or insignia on the pin 20. The stick pin 57 is adapted for use in a conventional manner with the tapered extremity 52 penetrating a users' garment whereby the garment retains the element 14 on the pin 20.

Figure 7:
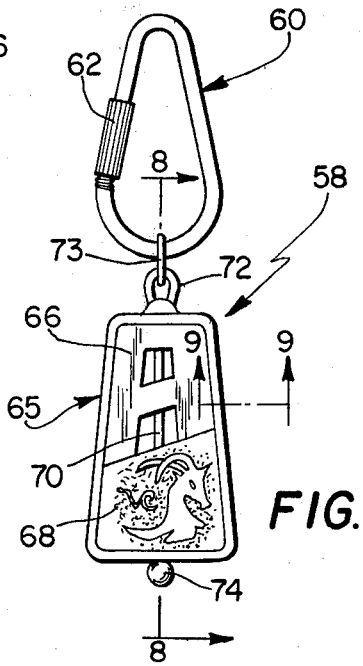
FIG. 7 is front elevational view of another alternate embodiment of the ornament of the instant invention.

Another alternate embodiment of the ornament of the instant invention which also defines a pendant, is generally indicated at 58 in FIG. 7. The pendant 58, as herein illustrated, is used in combination with a key ring 60, having a threaded sleeve 62 which is normally in threaded engagement with threads 64 but which is movable to a position of spaced disengagement therefrom to permit the assembly of keys and the like on the ring 60. It is understood, however, that the pendant 58 is equally suited for other jewelry applications, such as use in combination with jewelry chains, necklaces or the like.

The pendant 58 is of general trapezoidal configuration and generally comprises a trapezoidal outer frame 65, upper and lower pendant elements 66 and 68, respectively, an elongated pin 70 of substantially square cross section, an eyelet 72 integrally formed at the upper extremity of the pin 70, a connecting ring 73 which is interconnected to both the ring 60 and the eyelet 72, and a threaded ball 74 which is received in threaded engagement on the lower extremity of the pin 70.

Figure 8:
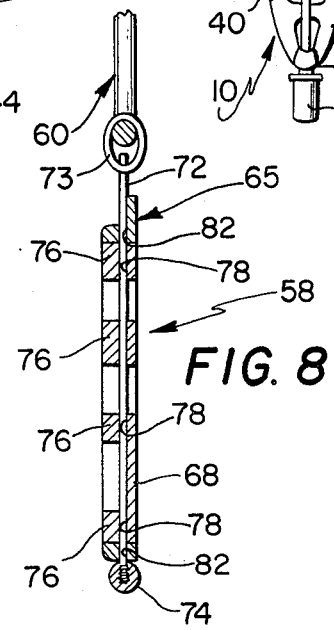
FIG. 8 is a side sectional view taken along line 8—8 in FIG. 7.

The elements 66 and 68 are most clearly illustrated in FIGS. 7 and 8. As will be seen, the element 66, as illustrated, embodies the capital letter A and the element 68 embodies a zodiac sign, and together they cooperate to define a trapezoidal configuration. Integrally formed with the elements 66 and 68 are rear sleeves 76 having aligned longitudinal apertures 78 of substantially square cross section.

Figure 9:
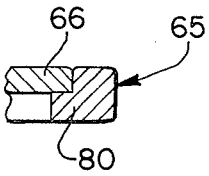
FIG. 9 is a sectional view taken along line 9—9 in FIG. 7.

The frame 65 is illustrated most clearly in FIGS. 7 and 9. As will be seen, the frame 65 defines an outer rim for the elements 66 and 68. In this connection, the frame 65 includes an inwardly extending flange 80, whereby the elements 66 and 68 are received in the frame 65 and retained in generally planar relation with the perimetric portions of the elements 66 and 68 engaging the flange 80. Aligned apertures 82 of substantially square cross section extend through the upper and lower transverse members of the frame 65 and the pin 70 extends therethrough and through the apertures 78 in the elements 66 and 68 to retain same in assembled relation in the frame 65. The ball 74 is received in threaded engagement on the lower extremity of the pin 70 and thereby cooperates with the eyelet 72 to retain the frame 65 and the elements 66 and 68 on the pin 70.

It is seen therefore that the instant invention provides a novel pendant construction which is adaptable for various forms of personalization. Virtually any combination of monogramatic and emblematic insignia can be assembled in either of the pendants 10 or 58 since the various elements are removably received on their respective pins. The stick pin 57 is also adapted for personalization with the element 14 slidingly received on the pin 20. For these reasons, the ornament construction of this invention has significant advantages of versatility over the monogramatic and emblematic ornaments heretofore known and represents a substantial advancement in the jewelry art.

While there is shown and described herein certain specific structure embodying this invention, it will be mainfest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A jewelry ornament comprising an elongated pin having an enlarged head, a plurality of ornament elements having apertures therethrough slidably received on said pin in substantially aligned relation, said pin being received in said apertures, retaining means releasably retaining said elements on said pin in abutting relation whereby said elements cooperate to define a pendant, and a frame defining an opening substantially the same configuration as the periphery of said ornament and having an inwardly extending flange, said ornament being received in said frame with the perimetric portion thereof engaging said flange, said frame having apertures therethrough aligned with said element apertures, said pin also being received in said frame apertures, said retaining means being disposed on said pin externally of said frame.

* * * * *